United States Patent [19]

Place

[11] 4,121,051

[45] Oct. 17, 1978

[54] SPEECH SYNTHESIZER

[75] Inventor: Harry Place, Ridgewood, N.J.

[73] Assignee: International Telephone & Telegraph Corporation, Nutley, N.J.

[21] Appl. No.: 811,009

[22] Filed: Jun. 29, 1977

[51] Int. Cl.[2] ..... G10L 1/00

[52] U.S. Cl. ..... 179/1 SM

[58] Field of Search ..... 179/1 SM, 1 SA

[56] References Cited

U.S. PATENT DOCUMENTS

| | | | |
|---|---|---|---|
| 3,575,555 | 4/1971 | Schanne | 179/1 SM |
| 3,631,520 | 12/1971 | Atal | 179/1 SA |
| 3,641,496 | 2/1972 | Slavin | 179/1 SM |
| 3,870,818 | 3/1975 | Barton et al. | 179/1 SM |
| 3,908,288 | 9/1975 | Brown | 179/1 SM |
| 3,928,722 | 12/1975 | Nakata et al. | 179/1 SM |
| 4,047,108 | 9/1977 | Bijker | 179/1 SA |

OTHER PUBLICATIONS

Master Specialties Corp. Brochure, "Expandable Voice Annunciator", 1976.

W. Buckholz, "Computer Controlled Audio Output," IBM Tech. Discl. Bull., Oct., 1960.

*Primary Examiner*—Thomas W. Brown

*Assistant Examiner*—E. S. Kemeny

*Attorney, Agent, or Firm*—John T. O'Halloran; Alfred C. Hill

[57] ABSTRACT

Upon operating a key on a phonetic keyboard, the clock circuit gate is opened to permit the counters, normally held in reset condition, to begin counting. Each of the memories (organized in 2048 × 8 bits) that are connected in parallel to the counters begin to emit the digital representation in CVSD (Controlled Variable Slope Delta Modulation) form of the repertoire of phonetic sounds with each memory containing the entire phonetic alphabet. The keyboard switch selects the desired data stream output from an addressed memory which represents the chosen phonetic sound, and guides this data stream to a CVSD demodulator, thus producing an analog representation of the desired sound. This sound may be amplified and reproduced by means of a loudspeaker or alternatively, it may be amplified and placed on a telephone line. A feature of the invention is a stop decode gate which automatically stops the counting for a short phonetic sound.

17 Claims, 1 Drawing Figure

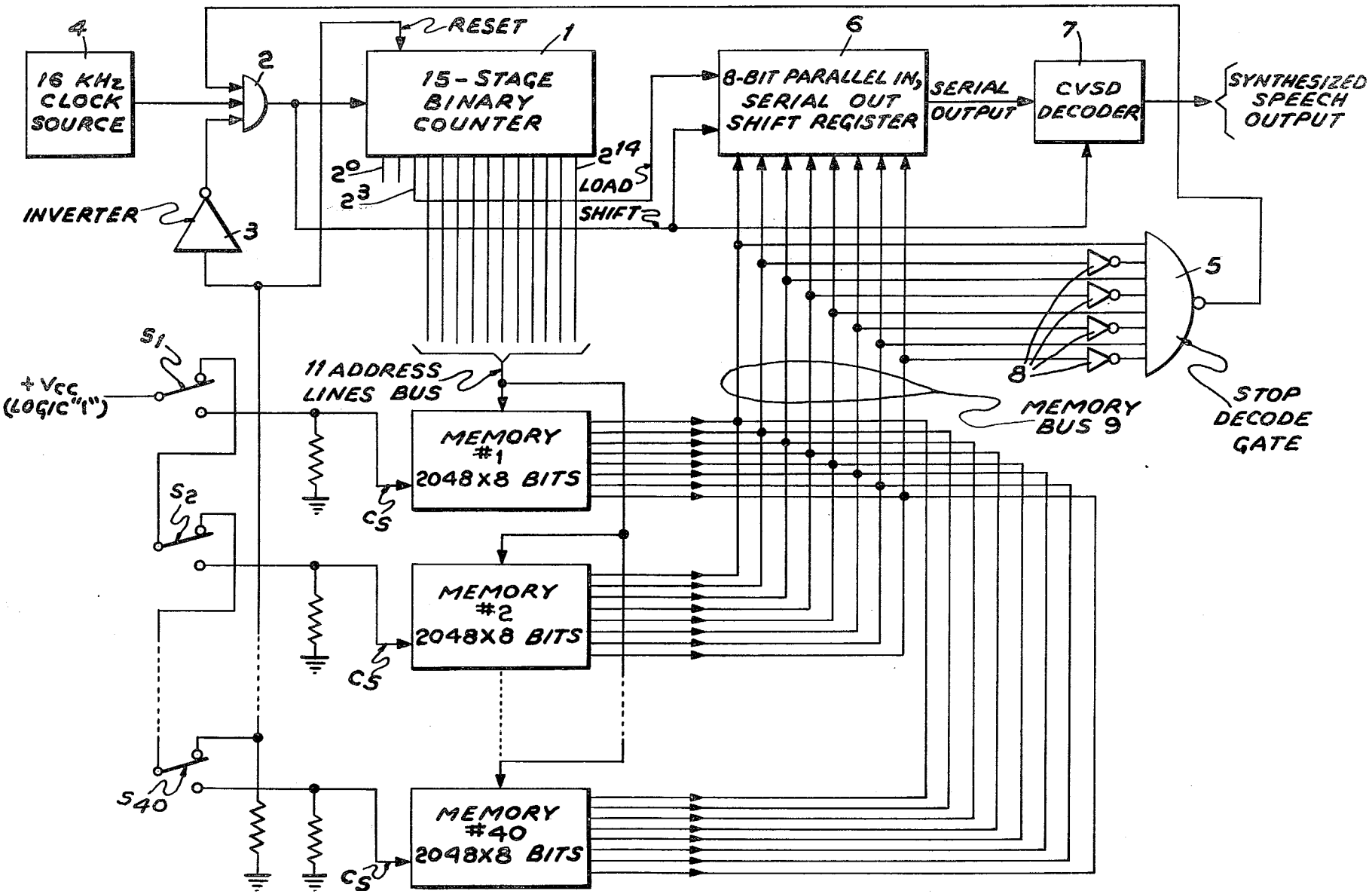
SYNTHESIZED SPEECH OUTPUT
STOP DECODE GATE
5
CVSD DECODER
7
MEMORY BUS 9
8
SERIAL OUTPUT
8-BIT PARALLEL IN, SERIAL OUT SHIFT REGISTER
6
$2^{14}$
LOAD
SHIFT
15-STAGE BINARY COUNTER
1
RESET
$2^0$
$2^3$
11 ADDRESS LINES BUS
MEMORY #1 2048X8 BITS
MEMORY #2 2048X8 BITS
MEMORY #40 2048X8 BITS
CS
2
3
INVERTER
4
16 KHz CLOCK SOURCE
S1
S2
S40
+Vcc (LOGIC "1")

SPEECH SYNTHESIZER

BACKGROUND OF THE INVENTION

This invention relates to the synthesization of sound and more particularly to a speech synthesizer using phonetic sounds.

The increased use of computers combined with telephone links has created a need for automated speech synthesizers. The use of automated speech provides a vehicle for the establishment of low cost transmission of the computed or retrieved data to a user at a distant location. To date, automated speech systems stored spoken words in memory, and upon activation by the external computer, the words are released, either singly, or in combination.

While this method produces and transmits the spoken word over a telephone line, this technique is limited in size and cost, since the vocabulary is limited by the number of word cells that can be economically stored in memory. In comparison, it may be compared to a typewriter that is arranged with a keyboard of words rather than letters. Such an arrangement would be obviously limited.

The use of automated speech synthesizers is not new, and a number of techniques have been developed to implement speech synthesizers. One such system was developed using optical sound tracks upon a drum, with the desired track selected by enabling a photo pickup adjacent to the desired sound track. Each revolution of the drum provided a sound recording time duration of one word length. The number of words that could thus be contained was equal to the number of sound tracks (rings) axially placed upon the drum.

In another arrangement musical sounds and phrases were placed upon a series of 36 separate tapes. The desired tape was thus selected and pulled over the read head on the respective track. Upon cessation of the sound, the tape was immediately restored to the initial position thus readying it for reuse. While the sound quality was very good, the reliability of this device was relatively low, and the tapes would eventually wear out.

In another arrangement an integrated circuit type memory speech reproducing system was developed with each memory element containing one spoken word (about one second of audible storage).

Synthesized speech systems have been developed over the past two decades, including vocoder type systems for speech digitization. These devices are costly, and often sound very metallic, providing a relatively poor reconstruction of vocal sounds.

SUMMARY OF THE INVENTION

An object of the present invention is to provide an improved speech synthesizer.

A feature of the present invention is the provision of a speech synthesizer comprising: N first means each having N phonetic sounds stored therein in digital form, where N is an integer greater than one; second means each coupled to a different one of the first means to select desired phonetic sounds in digital form from an addressed one of the first means; and third means coupled to the second means to convert the selected desired phonetic sounds in digital form to analog synthesized speech.

Another feature of the present invention is the inclusion, together with the above first, second and third means, of a fourth means coupled to the first means and the second means to automatically stop the operation of the third means for short phonetic sounds.

BRIEF DESCRIPTION OF THE DRAWING

Above-mentioned and other features and objects of this invention will become more apparent by reference to the following description taken in conjunction with the accompanying drawing, in which the single FIGURE is a block diagram of the speech synthesizer in accordance with the principles of the present invention.

DESCRIPTION OF THE PREFERRED EMBODIMENT

The present invention is a system where the entire phonetic alphabet is retained in each of the memory cells, and released in sequence in order to form words. While this requires more skill upon the part of the programmer or user of this system, particularly since there are more phonetic sounds (about 40) in contrast to the 26 letter alphabet, and timing is somewhat important in order to obtain a credible word, the disclosed system has no limit upon the words that may be formed with the 40 word phonetic alphabet. Further, since the present invention utilizes solid-state memory devices that are currently available, the system is both small in size, and relatively low in cost with respect to other type systems.

Finally, although the thrust of this disclosure is related to computer response application, there is another, separate application to which this technique may be applied. There are a number of diseases that cause a loss of speech or vocal capability in a person, yet the person remains in both a good physical and mental state. In such cases, this technique, when combined with a typewriter-style keyboard and loudspeaker type amplifier reproducing system, could provide a means for artificial voice communications. Because of the simplicity of the system of the present invention, the size, weight, and cost of such a system, it will likely be compatible with the needs of a person with such a disability.

The English language consists of words that are made up of about 40 distinguishable, separate vocal phonetic sounds. These are shown in the Table hereinbelow. There are three classes of sounds, (1) extended non-repetitive sounds; (2) short percussive sibilant sounds; and (3) continuous, unchanging sounds. These different types of sounds are indicated in the Table below since the class of sound being reproduced affects the hardware design.

TABLE OF VOCAL PHONETIC SOUNDS

| EXTENDED NON-REPETITIVE SOUNDS | | SHORT PERCUSSIVE SIBILANT SOUNDS |
|---|---|---|
| ă | - mat, snap | b - baby, rib |
| ā | - day, fade | ck - cook, kin, ache |
| ä | - father, bother, cart | ch - chin, nature |
| δ | - banana, abut, collect | d - did, address |
| ȧ | - air, mare | g - go, big |
| au | -now, loud | j - job, gem |
| ē | - bet, peck | t - tie, attach |
| ē | - beat, easy | p - pepper, lip |
| ī | - tip, active | w - we, away |
| ī | - site, buy | CONTINUOUS UNCHANGING SOUNDS |
| ō | - bone, know | f - fifty, cuff |
| ȯ | - saw, all | h - hat, ahead |
| oi | - coin, destroy | m - murmur, dim |
| ü | - rule, pool | n - no, own |
| u | - pull, wood | r - red, cur |

-continued

| TABLE OF VOCAL PHONETIC SOUNDS | |
|---|---|
| yü - youth, union, cue | s - source, less |
| yu - cure, fury | L - lily, pool |
| | sh - shy, mission |
| | v - vivid, give |
| | y - yard |
| | z - zone, raise |
| | zh - vision, azure |
| | th - thin, ether |
| | th - then, either |

Although the system of the present invention can be operated by means of a properly programmed computer that selects the phonetic sounds in a correct and timely manner, for purposes of simplicity in discussion the hand-keyed device will be described. In either case, it should be recognized that the basic operation of the system of this invention is the same.

Before describing the operation of the voice response unit in detail, the following summary of operation is provided. Upon operating any key in the phonetic keyboard, the clock circuit gate is opened to permit the counters, normally held in the reset condition, to begin counting. Each of the memories (organized in 2048 × 8 bits) that are parallel connected to the counters begin emitting the digital representation in controlled-variable-slope-delta modulation, otherwise known as CVSD of the repertoire of phonetic sounds with each memory containing the entire phonetic alphabet. The keyboard switch selects the desired data stream output from the memory device which represents the chosen phonetic sound, and places this data stream in a CVSD demodulator, thus producing an analog representation of the desired phonetic sound. This analog signal may then be amplified and reproduced by means of a loudspeaker, or alternatively, it may be amplified and placed upon a telephone line.

The FIGURE is a simplified embodiment of the present invention where switches S1–S40 are employed to manually activate the speech synthesizer. Switches S1–S40, each arranged in a typewriter keyboard fashion permits the user to compose the spoken word much like the office typewriter permits the composition of the written word. The keys, thus activated, produce the selected phonetic sounds in the desired sequence.

At reset, the normally closed contacts of switches S1–S40 cause the binary counter 1 to be held in the rest condition. These contacts also cause a binary "0" to be applied to AND gate 2 through inverter 3. AND gate 2 precedes counter 1, thus preventing the signal from the 16 KHz (kilohertz) continuously running clock source 4 from entering counter 1.

Upon activation of any of the forty switches (a number deemed necessary for the phonetic composition of the English language), the reset signal is removed from the 15-stage binary counter 1 and a logic "1" is applied to AND gate 2 through inverter 3. Since the stop decoder NAND gate 5 on the right side of the FIGURE is not activated, it likewise applies a logic "1" to AND gate 2. Thus enabled, the AND gate 2 responds to the clock signal, causing the 16 KHz clock to be coupled to counter 1, and thereby causing counter 1 to be incremented upon each successive clock pulse.

Note also, that the 16 KHz clock signal is applied to the shift conductor of an eight bit parallel input, serial output shift register 6 and the associated CVSD decoder 7. The CVSD decoder is a recognized method of digital-to-analog conversion technique for speech systems in current use.

As counter 1 is incremented, upon each eight count the memory address (shown as an eleven bit address to all memories #1 to #40 to address a 2048 word memory) is incremented by one. Also, shift register 6 is loaded with the new memory word output resulting from the new address applied to the memories #1 to #40. Thus, shift register 6 is continuously loaded with successive phonetic words contained in memories #1 to #40, the memory having been selected by the switch chosen by the user, i.e. operation of switch S2 applies a control signal to the chip select lead CS of memory #2, likewise operation of switch S40 similarly will select the contents of memory #40 via the CS lead to memory #40.

Since each memory #1–#40 contains the 40 phonetic sounds, selectable by means of the controlling switches and the contents of the memory is loaded into shift register 6 in an orderly fashion, converted to the serial format by shift register 6 necessary for the operation of the CVSD decoder 7, the resultant speech output of the CVSD decoder 7 will provide an electrical representation of the phonetic sound that may be applied to either a loudspeaker or other electrical communication device. Orderly selection of the phonetic sound by the operator thus will enable him to reproduce any word in the English language (assuming that each of the memories #1–#40 contain all English phonetic sounds).

Phonetic sounds, however, include both long, repetitive sounds, such as ā, ȧ, ē, and a variety of other vowel sounds, as well as short clipped sounds, such as *b, p, t,* and other sibilant consonants. Means are therefore provided in the present invention to accomodate sounds of various lengths. The stop-decoder-gate is provided to accomodate this and is an eight-leg NAND gate 5 which is arranged with suitable inverters 8 to decode an 8 bit word from the memory bus 9. Specifically, a 10101010 pattern on the memory bus 9 will activate NAND gate 5, causing the output signal to go low, and thus prevent the clock from clock source 4 from entering the remainder of the system causing stoppage of all further counting or other activity. A pattern as described above is a digital representation of silence in a CVSD system, and thus it is a logical pattern to follow short clipped sounds.

Thus, the presence of the pattern prevents counter 1 from recirculating through memories #1–#40, otherwise causing continuous repetition of the clipped sound, should the switch on the keyboard inadvertently be held by the operator for too long a period.

Long vowel sounds will vary in length, selectable by the operator. In some instances, it is expected that the vowel may be held longer than a complete binary count, in which case the memory will recycle two or more times. Absence of a stop pattern will permit this to occur, in this instance.

Thus, the present invention, as described will permit the variation of continuous, long vowel sounds, the length controllable by the operator, i.e. the vowel sound will continue to be reproduced for the duration that the switch is held depressed. Alternatively, the use of the stop code permits short consonant sounds to be reproduced only once during a given key depression, the stop code preventing the hazard of repetition, should the depressed switch be held.

Although the present invention, as described illustrates the use of switches, as embodied in a keyboard fashion, the present invention shall also embrace computer-controlled operation by means of logic gates or other entry methods in order to provide a computer-controlled speech synthesizer.

Also, although the present invention illustrates the use of CVSD, a popular method of speech digitization, this does not preclude the use of normal binary coding or other types of coding, and in fact, covers any other method of speech digitization technique.

Further, the present invention illustrates the use of a single memory element for retaining all of the 40 phonetic sounds. It is, of course, possible to retain two or more such phonetic sounds in a single memory location, the selector switch thus selecting the appropriate memory location to be applied to the memory bus as well as selecting the appropriate memory integrated circuit as shown in the FIGURE. The present invention, therefore shall include all such memory-sharing embodiments, or memories of other than the semi-conductor type.

While I have described above the principles of my invention in connection with specific apparatus it is to be clearly understood that this description is made only by way of example and not as a limitation to the scope of my invention as set forth in the objects thereof and in the accompanying claims.

I claim:

1. A speech synthesizer comprising:

N first means each having N phonetic sounds stored therein in digital form, where N is an integer greater than one;

second means each coupled to a different one of said first means to select desired phonetic sounds in digital form from an addressed one of said first means;

third means coupled to said second means to convert said selected desired phonetic sounds in digital form to analog synthesized speech; and a fourth means coupled to said first means and said second means to automatically stop the operation of said third means for short phonetic sounds;

said first means including

N memories; and said second means including

N switch means each coupled to a different one of said memories to select said desired phonetic sounds, a clock source, a binary counter to generate a different address for each of said memories, and an AND gate coupled to said switch means, said clock source and said fourth means to control the coupling of the clock of said source to said counter.

2. A synthesizer according to claim 1, wherein said third means includes a M-bit parallel in, serial out shift register coupled to each of said memories, said binary counter to load said selected desired phonetic sounds into said shift register and said AND gate to control the shifting of said shift register, where M is an integer greater than one but different than N, and a digital-to-analog converter coupled to said shift register and said AND gate to produce said analog synthesized speech.

3. A synthesizer according to claim 2, wherein said phonetic sounds are coded according to a controlled-variable-slope-delta modulation code, and said converter includes a controlled-variable-slope-delta modulation decoder.

4. A synthesizer according to claim 3, wherein said fourth means includes a NAND gate coupled directly to selected ones of the conductors carrying said M-bits, and inverters coupled between the remaining ones of the conductors carrying said M-bits and said NAND gate, said NAND gate detecting a predetermined code which indicates a short phonetic sound and produces a control signal coupled to said AND gate to stop the operation of said converter.

5. A synthesizer according to claim 4, wherein

N is equal to 40, and

M is equal to 8.

6. A synthesizer according to claim 1, wherein bits of said selected desired phonetic sounds are conducted on a different one of M-conductors, where M is an integer greater than one but different than N; and said fourth means includes a NAND gate coupled directly to selected ones of said conductors, and inverters coupled between the remaining ones of said conductors and said NAND gate, said NAND gate detecting a predetermined code which indicates a short phonetic sound and produces a control signal coupled to said second means to stop operation of said third means.

7. A speech synthesizer comprising:

N first means each having N phonetic sounds stored therein in digital form, where N is an integer greater than one;

second means each coupled to a different one of said first means to select desired phonetic sounds in digital form from an addressed one of said first means; and third means coupled to said second means to convert said selected desired phonetic sounds in digital form to analog synthesized speech;

said first means including

N memories; and said second means including

N switch means each coupled to a different one of said memories to select said desired phonetic sounds, a clock source, a binary counter to generate a different address for each of said memories, and an AND gate coupled to said switch means, said clock source and a fourth means to control the coupling of the clock of said source to said counter.

8. A synthesizer according to claim 7, wherein said third means includes a M-bit parallel in, serial out shift register coupled to each of said first means, said binary counter to load said selected desired phonetic sounds into said shift register and said AND gate to control the shifting of said shift register, where M is an integer greater than one but different than N, and a digital-to-analog converter coupled to said shift register and said AND gate to produce said analog synthesized speech.

9. A synthesizer according to claim 8, wherein said phonetic sounds are coded according to a controlled-variable-slope-delta modulation code, and said converter includes a controlled-variable-slope-delta modulation decoder.

10. A synthesizer according to claim 9, wherein

N is equal to 40, and

M is equal to 8.

11. A speech synthesizer comprising:

N first means each having N phonetic sounds stored therein in digital form, where N is an integer greater than one;

second means each coupled to a different one of said first means to select desired phonetic sounds in digital form from an addressed one of said first means; and third means coupled to said second means to convert said selected desired phonetic sounds in digital form to analog synthesized speech;

said second means including

N switch means each coupled to a different one of said first means to select said desired phonetic sounds, a clock source, a binary counter to generate a different address for each of said memories, and an AND gate coupled to said switch means, said clock source and a fourth means to control the coupling of the clock of said source to said counter.

12. A synthesizer according to claim 11, wherein said third means includes a M-bit parallel in, serial out shift register coupled to each of said first means, said binary counter to load said selected desired phonetic sounds into said shift register and said AND gate to control the shifting of said shift register, where M is an integer greater than one but different than N, and a digital-to-analog converter coupled to said shift register and said AND gate to produce said analog synthesized speech.

13. A synthesizer according to claim 12, wherein said phonetic sounds are coded according to a controlled-variable-slope-delta modulation code, and said converter includes a controlled-variable-slope-delta modulation decoder.

14. A synthesizer according to claim 13, wherein

N is equal to 40, and

M is equal to 8.

15. A speech synthesizer comprising:

N first means each having N phonetic sounds stored therein in digital form, where N is an integer greater than one;

second means each coupled to a different one of said first means to select desired phonetic sounds in digital form from an addressed one of said first means; and third means coupled to said second means to convert said selected desired phonetic sounds in digital form to analog synthesized speech;

said third means including a M-bit parallel in, serial out shift register coupled to each of said first means, a binary counter to load said selected desired phonetic sounds into said shift register and an AND gate to control the shifting of said shift register, where M is an integer greater than one but different than N, and a digital-to-analog converter coupled to said shift register and said AND gate to produce said analog synthesized speech.

16. A synthesizer according to claim 15, wherein said phonetic sounds are coded according to a controlled-variable-slope-delta modulation code, and said converter includes a controlled-variable-slope-delta modulation decoder.

17. A synthesizer according to claim 16, wherein

N is equal to 40, and

M is equal to 8.

* * * * *